US005762322A

United States Patent [19]

Smith

[11] Patent Number: 5,762,322

[45] Date of Patent: Jun. 9, 1998

[54] ACTUATOR ASSEMBLY TO PREVENT INADVERTENT PRODUCT DISCHARGE UPON INSTALLATION ON STEM

[75] Inventor: Jeremy Smith, Loudon, N.H.

[73] Assignee: Summit Packaging Systems, Inc., Manchester, N.H.

[21] Appl. No.: 712,620

[22] Filed: Sep. 13, 1996

[51] Int. Cl.[6] ..... B65D 83/20

[52] U.S. Cl. ..... 251/353; 251/77; 137/68.11; 222/402.11; 222/402.25

[58] Field of Search ..... 251/77, 353; 137/68.11; 222/402.11, 402.25

[56] References Cited

U.S. PATENT DOCUMENTS

| | | | |
|---|---|---|---|
| 3,225,966 | 12/1965 | Sagarin . | |
| 3,227,321 | 1/1966 | Sagarin . | |
| 3,263,868 | 8/1966 | Sagarin . | |
| 3,308,857 | 3/1967 | McGhie . | |
| 3,325,054 | 6/1967 | Braun . | |
| 3,327,908 | 6/1967 | O'Donnell et al. . | |
| 3,348,740 | 10/1967 | O'Donnell . | |
| 3,415,426 | 12/1968 | Kleveland . | |
| 3,503,539 | 3/1970 | O'Donnell . | |
| 3,598,290 | 8/1971 | Steiman . | |
| 3,674,184 | 7/1972 | Ewald . | |
| 3,734,354 | 5/1973 | Gach . | |
| 3,770,168 | 11/1973 | Sagarin . | |
| 4,024,995 | 5/1977 | Landen | 222/402.11 |
| 4,095,725 | 6/1978 | Goncalves . | |
| 4,322,037 | 3/1982 | Heeb et al. . | |
| 4,482,082 | 11/1984 | Goncalves . | |
| 4,511,064 | 4/1985 | Ruscitti et al. . | |
| 5,027,982 | 7/1991 | Demarest . | |
| 5,085,353 | 2/1992 | Inui et al. . | |
| 5,139,201 | 8/1992 | De Laforcade . | |
| 5,158,211 | 10/1992 | Meshberg . | |
| 5,205,443 | 4/1993 | Inui et al. . | |
| 5,320,255 | 6/1994 | Stoffel et al. . | |
| 5,385,303 | 1/1995 | Gosselin et al. . | |
| 5,388,730 | 2/1995 | Abbott et al. | 222/402.11 |

*Primary Examiner*—A. Michael Chambers
*Attorney, Agent, or Firm*—Davis And Bujold

[57] ABSTRACT

An actuator assembly for an aerosol container containing a product to be dispensed. The actuator assembly comprises a base having a through bore extending therethrough and a mechanism for securing the base member to a mounting cup of the aerosol container. An actuator is supported in the through bore of the base and is slidable along a longitudinal axis thereof via a pair of mating bearing and guide surfaces. The through bore contains a pair of opposed stop members which permanently retain the actuator within the through bore. The actuator is allowed to slide within the through bore, during installation of the actuator assembly onto an aerosol container, to prevent the actuator from sufficiently engaging with or depressing the valve stem so that inadvertent discharge of the product contents is prevented until actual use of the aerosol container by the end user.

20 Claims, 4 Drawing Sheets

ACTUATOR ASSEMBLY TO PREVENT INADVERTENT PRODUCT DISCHARGE UPON INSTALLATION ON STEM

FIELD OF THE INVENTION

This invention relates to an improved actuator assembly for an aerosol valve and, more particularly to an improved actuator assembly having a construction which prevents the valve from being unintentionally or accidentally discharged during installation of the actuator assembly onto an aerosol container.

BACKGROUND OF THE INVENTION

There are a number of known actuator assemblies which are presently known in the art. However, many of these actuator assemblies, upon installation of the actuator assembly onto an aerosol container, actuate the aerosol valve for a brief period of time, e.g. a fraction of a second or so, which discharges a small portion of the container contents. This can create a substantial health problem as installation of the actuator assembly onto the aerosol container generally occurs at one location and there are a plurality of actuator assemblies being installed onto aerosol containers over the course of a day or a production shift. This becomes especially problematic if the contents of the aerosol container are poisonous or some other hazardous material.

SUMMARY OF THE INVENTION

Wherefore, it is an object of the present invention to overcome the aforementioned problems and drawbacks associated with the prior art designs.

Another object of the invention is to minimize the possibility of the product contents being accidentally or unintentionally discharged from the aerosol container upon installation of the actuator assembly.

Still another object of the invention is to provide an actuator assembly in which the actuator "floats" freely relative to the base and does not positively engage the stem of the aerosol valve until an operator sufficiently depresses the actuator to dispense the product contents of the aerosol container for the first time thereby permanently engaging the actuator with the valve stem.

A further object of the invention is to provide an actuator assembly which is relatively simple in construction and easy to manufacture.

A still further object of the invention is to provide an actuator assembly which can be provided with an overcap.

Another object of the invention is to provide a base which can be secured to either the inwardly facing surface or the outwardly facing surface of a mounting cup of an aerosol container.

A further object of the invention is to provide an actuator with a first bearing surface and the base with a mating second bearing surface which allow the actuator to move freely axially relative to the base between a pair of stop surfaces.

Yet another object of the invention is to provide the base of the actuator assembly with a through bore, having a guide mechanism, and to locate the actuator at least partially within the through bore in cooperation with the guide mechanism which prevents rotation of the actuator relative to the base but allows the actuator to move freely up and down along a longitudinal axis of the through bore.

The present invention relates to an actuator assembly for an aerosol container containing stem for controlling dispensing of an aerosol product, said actuator assembly comprising: a base defining a longitudinal axis and having a though bore extending therethrough, and a mechanism for attaching said base to an aerosol container containing an aerosol product; and an actuator being at least partially supported within said though bore, and said actuator having a product inlet and a discharge outlet, communicating with one another for dispensing the aerosol product; wherein said actuator is slidable along said longitudinal axis of said though bore a sufficient distance such that said inlet of said actuator insufficiently engages with a stem of the aerosol container, upon completion of installation of said actuator assembly on the aerosol container, so as to prevent discharge of any of the aerosol product during installation of said actuator assembly on the aerosol container.

The present invention also relates to an actuator assembly in combination with an aerosol container; said aerosol container comprising a substantially closed container being opened at one end thereof, a mounting cup closing the open end of said aerosol container and supporting a valve, a valve stem extending through said mounting cup and having an opposed end thereof communicating with an interior of said aerosol container, via a passageway, for dispensing of an aerosol product from said aerosol container to the exterior environment; said actuator assembly comprising: a base defining a longitudinal axis and having a though bore extending therethrough, and a mechanism for attaching said base to said aerosol container containing an aerosol product; and an actuator being at least partially supported within said though bore, and said actuator having a product inlet and a discharge outlet, communicating with one another, for dispensing the aerosol product; wherein said actuator is slidable along said longitudinal axis of said though bore a sufficient distance such that said inlet of said actuator insufficiently engages with said stem of the aerosol container, upon completion of the installation of said actuator assembly on said aerosol container, so as to prevent discharge of any of the aerosol product during installation of said actuator assembly on the aerosol container.

The present invention further relates to a method of installing an actuator assembly on an aerosol container without discharging any aerosol product during installation, said method comprising the steps of: forming a though bore within a base, and the though bore defining a longitudinal axis; providing a mechanism for attaching said base to an aerosol container containing an aerosol product; at least partially supporting an actuator within said though bore, and said actuator having a product inlet and a discharge outlet, communicating with one another, for dispensing the aerosol product; and allowing said actuator to slide along said longitudinal axis of said though bore a sufficient: distance such that said inlet of said actuator insufficiently engages with a stem of the aerosol container, upon completion of the installation of said actuator assembly on the aerosol container, so as to prevent discharge of any of the aerosol product during installation of said actuator assembly on the aerosol container.

The above and other objects of the present invention will be readily understood with reference to the following description and the appended drawings.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
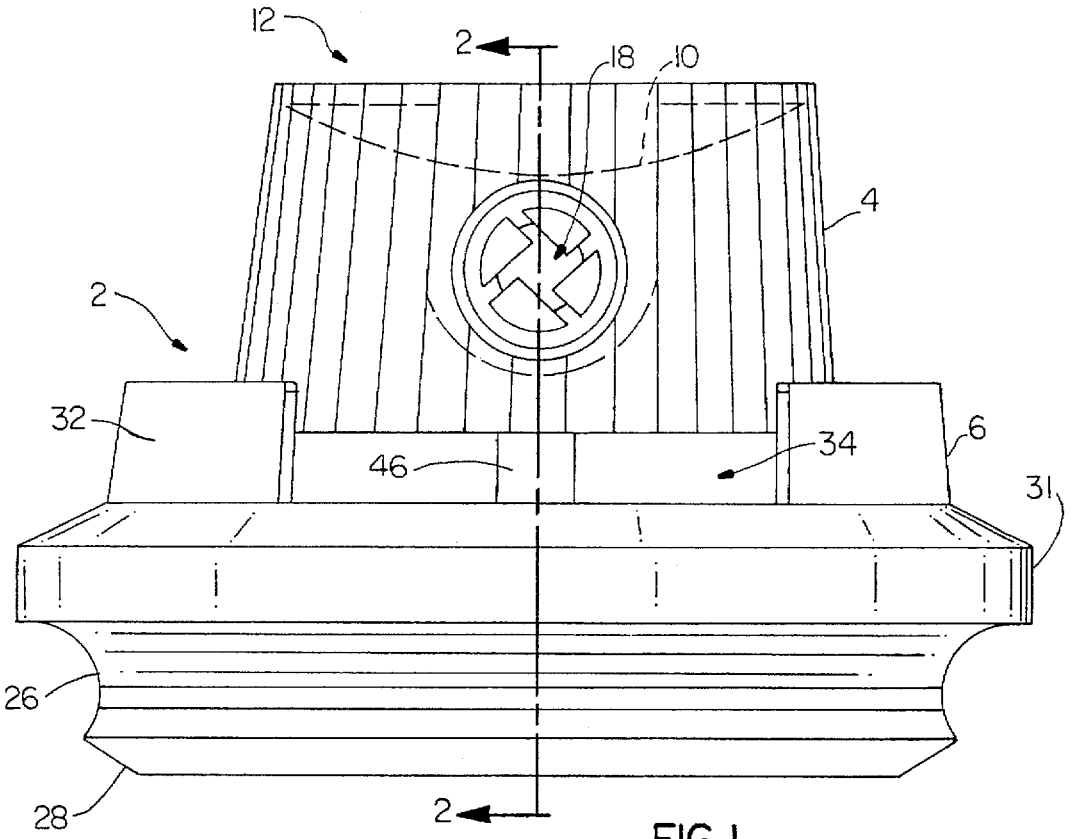
FIG. 1 is a diagrammatic front elevational view of an actuator assembly according to the present invention.
Figure 2:
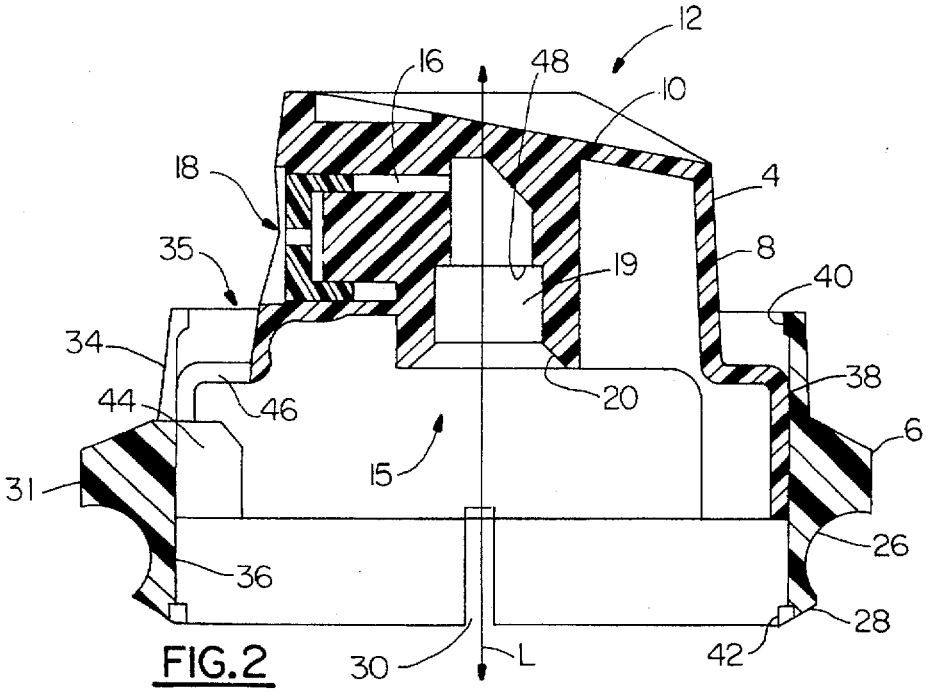
FIG. 2 is a diagrammatic cross-sectional view of the actuator assembly of FIG. 1 taken along section line 2—2.
Figure 3:
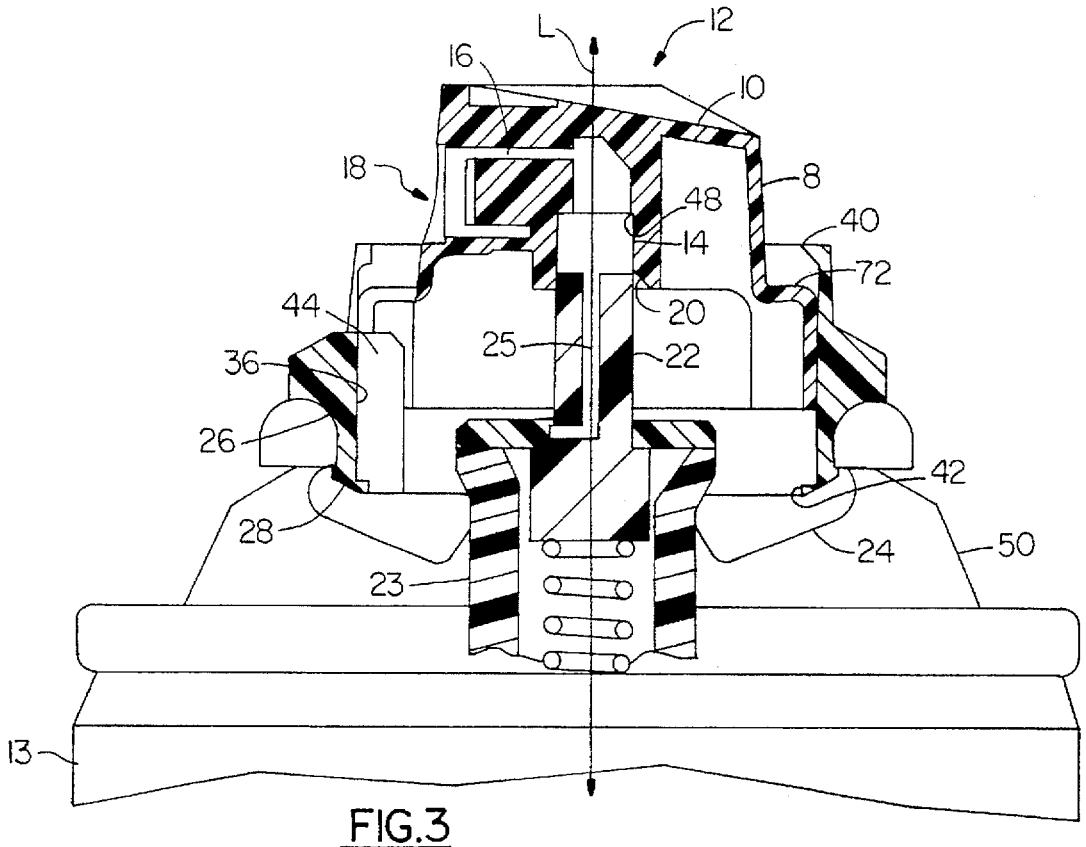
FIG. 3 is a diagrammatic cross-sectional view, similar to that of FIG. 2, showing the actuator assembly mounted to a mounting cup of an aerosol container.

Turning now to FIGS. 1–3, a detailed description concerning a first embodiment of the present invention will now be provided. As can be seen in those figures, the actuator assembly 2 includes an actuator 4 supported by a base 6. The actuator 4 has an exterior sidewall surface 8 and includes a finger recess 10, formed in a top surface 12 of the actuator, for facilitating depressing of the actuator 4 and dispensing of the product contents of an aerosol container 13.

The actuator 4 is provided with an inlet 15 (FIG. 2) leading to an internal central bore 14 which communicates with a radial bore 16 for supplying product to a discharged outlet 18 where the product contents are discharged from the actuator 2 into the environment. The inlet 15 is defined by a chamfered surface 20 which facilitates engagement with a stem 22 of an aerosol valve 23 attached to a mounting cup 24 (FIG. 3). The valve is provided with a passageway 25 which facilitates conveyance of the product contents from the aerosol container 13, via a dip tube (not shown), to the central bore 14 of the actuator 4. As the valve 23 is a conventional aerosol valve and forms no inventive part of the present invention per se, a further detailed discussion concerning the same is not provided herein.

The base 6 is provided with an exterior semicircular shaped annular recess 26 at a lower portion thereof remote from the actuator 4. The lower most surface of the base 6 is beveled, at 28, to assist with proper engagement between the annular recess 26 of the base 6 and an inner surface of the mounting cup 24.

At least one cutout section 30, preferably a pair of cutout sections 30, extending through both annular recess 26 and beveled surface 28 and are provided to facilitate radially inward biasing of those members as the base 6 is received within the mounting cup 24. Once the base 6 Is fully received within the mounting cup 24, the lower most portion of the base 6 is allowed to spring radially outwardly, due to its inherent resilience, to permanently maintain the engagement between the base 6 and the mounting cup 24.

A shoulder 31 is provided on the base 6 and it functions as a stop to prevent over-insertion of the base 6 in the mounting cup. The portion of the base 6 adjacent the actuator 4 is provided with an annular collar 32 which extends in an axial direction and has a gap or collar opening 34 provided therein to facilitate discharge of the product contents of the pressurized container 13, and a further discussion concerning the same will follow below.

The base 6 has a through bore 35 extending there-through which defines a longitudinal axis L of the actuator assembly. The actuator 4 is at least partially accommodated within the through bore 35 and an inwardly facing surface of the through bore forms a base cylindrical guide or bearing surface 36 while an outwardly facing surface of the actuator forms an actuator cylindrical guide or bearing surface 38. The bearing surfaces 36, 38 facilitate free axial movement of the actuator 4 along the longitudinal axis L and the importance of this feature will he discussed below. A radially inwardly facing first annular stop member 40 is provided adjacent one axial end of the through bore 35 while a radially inwardly facing second annular stop member 42 is provided adjacent the other axial end of the through bore. The first and second annular stop members 40, 42 limit the axial travel of the actuator 4 relative to the base 6. The annular stop members 40, 42 prevent the actuator 4 from being separated from the base 6 during the manufacturing and installation processes while the first annular stop member 40 also functions to retain the actuator 4 after installation of the actuator assembly 2.

The bearing surface 36 of the base is provided with a guide member 44, e.g. an elongate rectangular member having a chamfered leading edge, which intimately engages within a rectangular shaped guide slot 46 provided in the bearing surface 38 of the actuator. The guide member 44 and the guide slot (cooperating guide slot member) 46 cooperate with one another to prevent the actuator 4 from turning, spinning or rotating, relative to the base 6, and maintains those two components in precise alignment with one another so that the discharge outlet 18 of the actuator is centered relative to the collar opening 34 of the base 6 to facilitate dispensing of the product contents therethrough.

During installation of the actuator assembly 2 onto the mounting cup 24, supported by a dome 50 of an aerosol container 13, the base 6 is forced, by mechanical means (not shown), into mating engagement with the mounting cup 24. This causes annular recess 26 and bevel surface 28 to both be biased radially inward, which is facilitated by the at least one cutout section 30, until the base 6 is completely received by the mounting cup 24.

It is to be appreciated that the actuator assembly 2 must be designed such that the engagement friction between the stem 22 and the central bore 14 is greater than the sliding friction between the bearing surface 36 of the base and the bearing surface 38 of the actuator. Due to such design, the actuator 4 is biased in the direction of the longitudinal axis L upon installation of the actuator assembly 2, via sliding engagement between bearing surface 36 along bearing surface 38, since the engagement friction between the central bore 14 and the stem 22 is greater and, thus, the stem 22 does not engage and/or sufficiently depress the stem 22 so that none of the product contents is discharged upon installing the actuator assembly 2 onto the mounting cup 24. The first annular stop member 40 continuously retains the actuator 4 within the through bore 35 and prevents the actuator 4 from becoming sufficiently separated therefrom.

After completion of the installation process, the actuator 4 merely rests upon top of the stem 22 but is still free floating and not permanently engaged therewith, i.e. the actuator 4 is able to move along longitudinal axis L between the stem 22 and the first annular stop 40 (see FIG. 3). It is to be appreciated that the free floating axial movement of the actuator 4 is more restrictive, however, once the actuator assembly 2 is installed onto a mounting cup 24. In some instances, depending upon the design, there may not be any permissible axial movement of the actuator 4 once the actuator assembly 2 is installed on a mounting cup 24. An important feature is that the actuator must not sufficiently depress the stem 22 so as to discharge any of the product contents of the aerosol container 13. Once an end user purchases the aerosol container and desires to dispense the product contents, the end user depresses actuator 4 by placing a finger in finger recess 10. The Initial depression stroke typically causes the stem 22 to be forced into and received by the central bore 14 of the actuator 4. Once the stem 22 is sufficiently received therein and abuts against bore shoulder 48, further depression of the actuator 4 depresses the stem 22 and thereby dispenses the product contents from the valve 23 through the valve bore 25 of the valve stem 22 and into the central bore 14 where it is conveyed to the discharge outlet 18. It is to be appreciated that the stem 22 may be partially or completely depressed, depending upon the degree of friction between those two components, prior to the stem 22 abutting against shoulder 48 and being permanently retained within the central bore 14. Following the initial discharge of the product contents from the aerosol container 13, the engagement between the stem 22 and the central bore 14 is thereafter continuously maintained.

Figure 4:
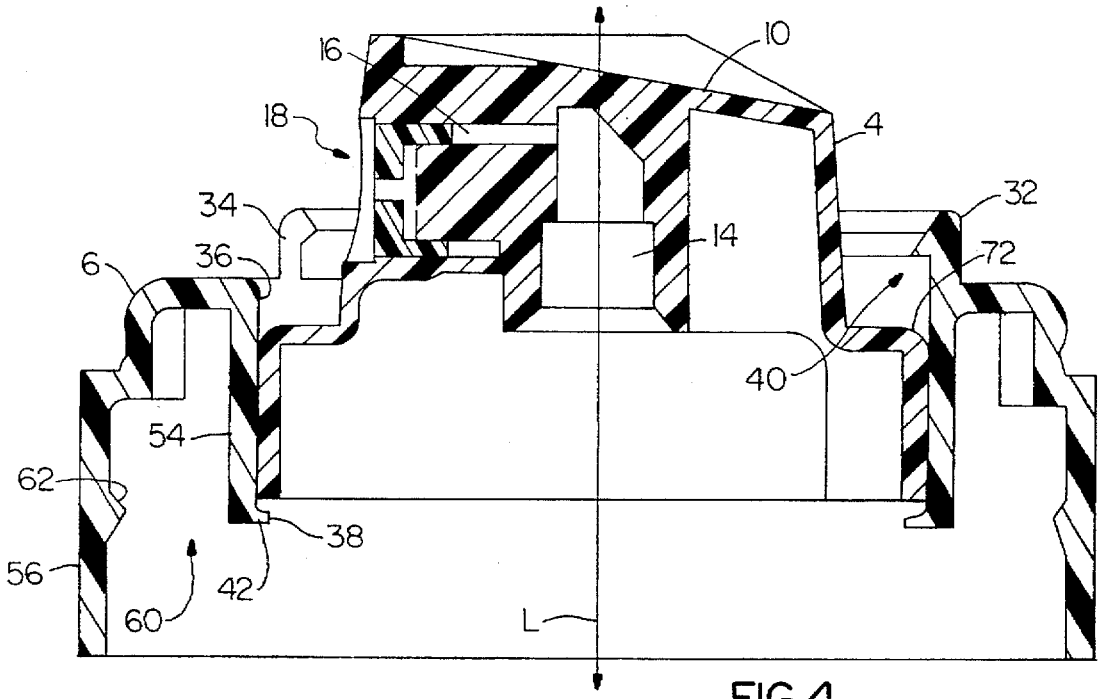
FIG. 4 is a diagrammatic cross-sectional view of a second embodiment of the actuator assembly according to the present invention.
Figure 5:
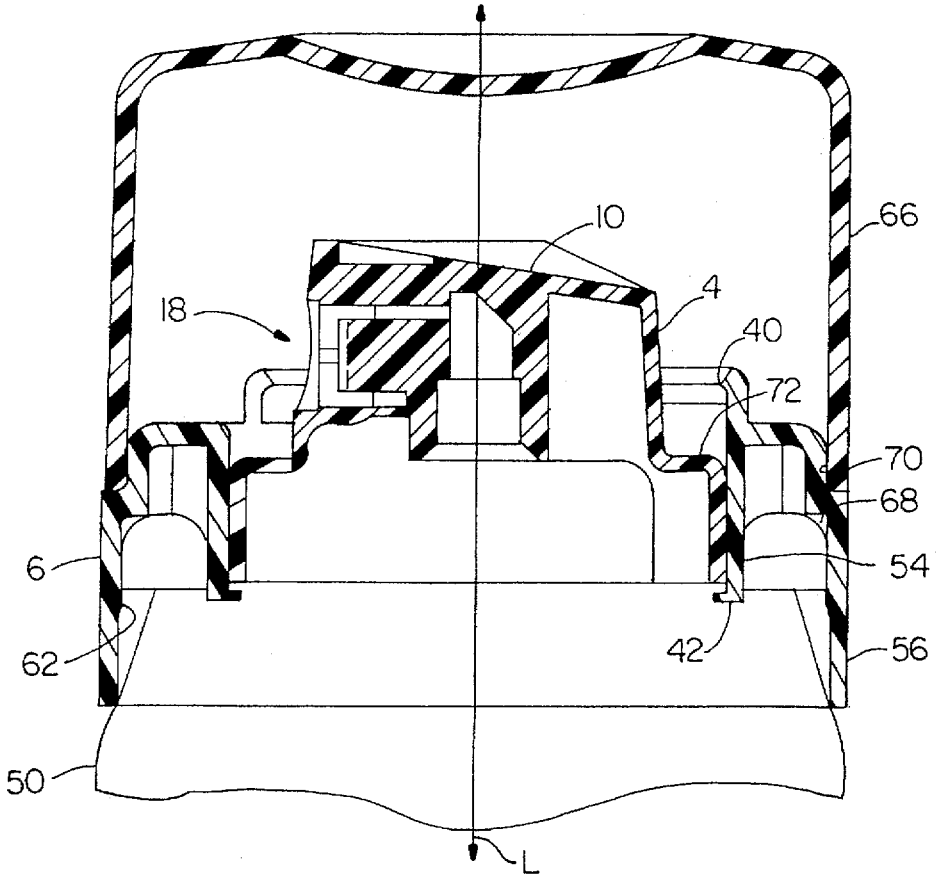
FIG. 5 is a diagrammatic cross-sectional view of the actuator assembly of FIG. 4 shown with a overcap.

Turning now to FIGS. 4 and 5, a second embodiment of the present invention will now be discussed in detail. Identical elements of this embodiment are provided with identical reference numerals to the previous embodiment and thus are not explained in any further detail. The major difference between this embodiment and the previous embodiment is that the base member 6 is provided with both an inner downwardly extending cylindrical wall 54 and an outer downwardly extending cylindrical wall 56 which define therebetween a cylindrical cavity 60. An inwardly facing annular member or rib 62 is located on an inwardly facing surface of the outer cylindrical wall 56 to engage with the outer surface of a mounting cup or rim securing a valve assembly to an aerosol container 13. The final installation of this embodiment to an aerosol container can be seen in FIG. 5 of the drawings.

The difference between the embodiment of FIG. 4 and that of FIG. 5 is that the FIG. 4 embodiment is not provided with an overcap while the embodiment of FIG. 5 is provided with an overcap 66. The overcap has an inwardly facing annular protrusion 68, on a skirt thereof, which is located to mate with an outwardly facing annular groove 70 provided in the base 6 for releasably retaining the overcap 66 in engagement with the base 6. As with the previous embodiment, collar 32 is provided with collar opening 34. Mating guide member 44 and guide slot 46, supported by the respective bearing surface 36, 38, cooperate with one another to maintain proper alignment between the actuator 4 and the base 6.

Figure 6:
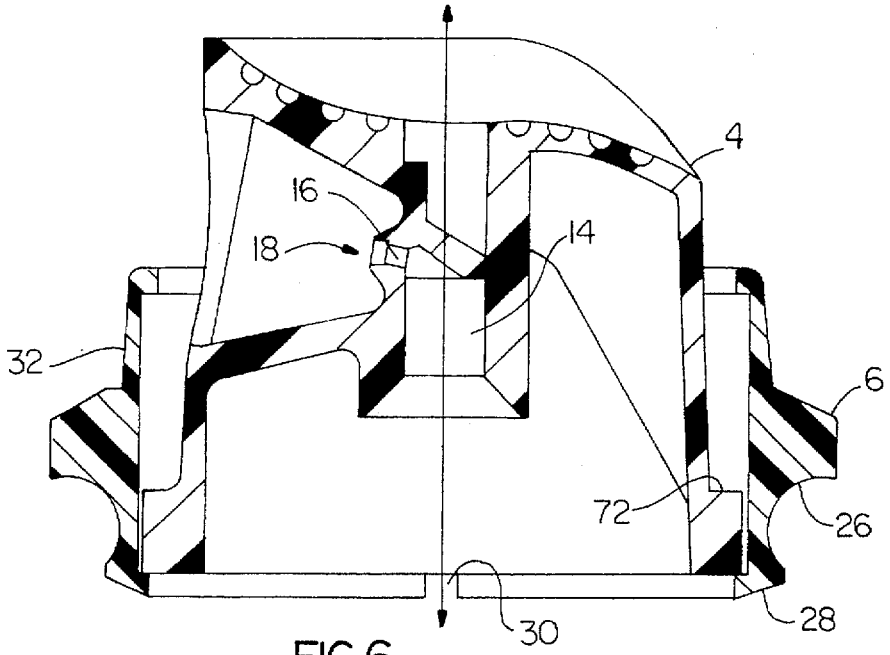
FIG. 6 is a diagrammatic cross-sectional view of a third embodiment of the present invention.

With reference now to FIG. 6, a third embodiment of the present invention will now be provided. This embodiment is very similar to the first embodiment in that the base is provided with annular recess 26 and bevel surface 28 having at least one cutout section 30 therein. However, the exterior shape of the actuator 4 has been modified and the radial bore 16, communicating with central bore 14, is arranged to discharge the product contents at an angle less than 90° relative to the longitudinal axis L of the actuator assembly, e.g. at an angle of about 60 to 85 degrees and preferably about 80 degrees. Due to this inclination of the radial bore 16 and the discharge outlet 18, relative to the longitudinal axis L, it is not necessary to provide a collar opening in collar 32 of base 6. In addition, guide member and guide slots can be eliminated as the alignment or rotational orientation of the actuator 4, relative to the base 6, is not critical as the actuator can be rotated or spun in either direction without the product contents being discharged against an inner surface of collar 32 or base 6 during dispensing.

Figure 7:
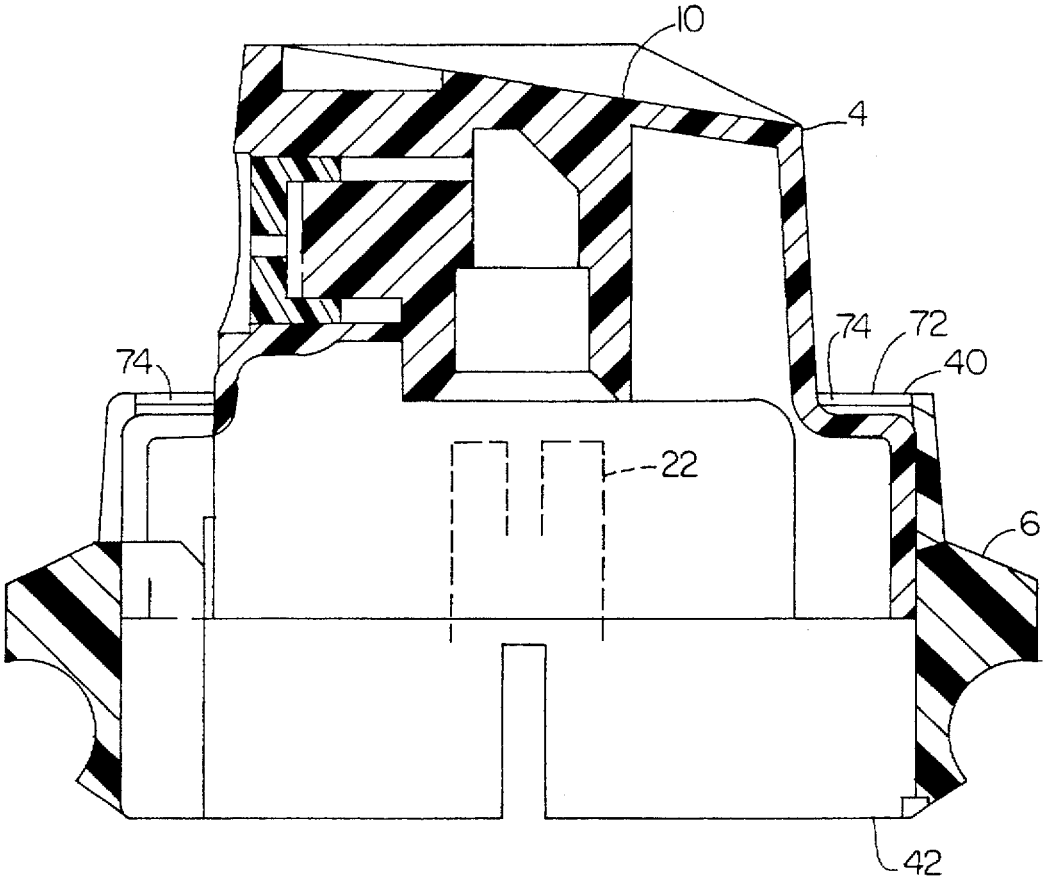
FIG. 7 is a diagrammatic cross-sectional view of a fourth embodiment of the present invention.

In the event that a tamper proof indicator is required for the actuator assembly 2, the valve 4 can be positioned relative to the base member 6 such that the actuator shoulder 72 is in abutting engagement with the first annular stop member 40, as can be seen in FIG. 7. Once located in this position, one or more frangible legs 74 can interconnect the actuator 4 to the base 6. When the actuator 4 is so positioned and the actuator assembly 2 is, in turn, mounted on a mounting cup or rim, the actuator 4 is maintained in a spaced relationship from the stem 22 (partially shown in dashed lines) after completion of the installation procedure. This arrangement prevents inadvertent discharge of the product contents during installation of the actuator assembly 2 and also provides a tamper indicator, i.e. the legs 74 must be broken in order to utilize actuator 4 to dispense the product contents from the aerosol container 13.

The base and the actuator can be manufactured from polypropylene or polyethylene, for example.

It is to be appreciated that other arrangements which allow the actuator to float freely or move longitudinally along longitudinal axis L, relative to the base 6, are considered within the spirit and scope of the present invention. The important feature of the present invention is that there be relative movement between the actuator 4 and the member 6 so that the base member can be installed onto an aerosol container without the actuator being permanently seated and/or sufficiently depressing the stem 22. Further, the actuator 4 must be supported by the base 6 so that the central bore 14 is in properly alignment with the stem 22 so that those two members can be brought into permanent engagement with one another, during initial discharge of the aerosol container product contents, so that such engagement will be permanently retained thereafter.

Since certain changes may be made in the above described actuator assembly for an aerosol container, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. An actuator assembly for an aerosol container containing a stem for controlling dispensing of an aerosol product, said actuator assembly comprising:

a base defining a longitudinal axis and having a though bore extending therethrough, and an attachment mechanism for attaching said base to an aerosol container containing an aerosol product; and an actuator being at least partially supported within said though bore, and said actuator having a product inlet and a discharge outlet, communicating with one another, for dispensing the aerosol product;

wherein said through bore and said actuator are provided with cooperating members which permanently retain said actuator within said through bore and permanently align said actuator relative to said base to prevent rotation of said actuator relative to said base about said longitudinal axis, while said cooperating members allow said actuator to slide along said longitudinal axis of said though bore a sufficient distance such that said inlet of said actuator insufficiently engages with a stem of the aerosol container, upon completion of installation of said actuator assembly on the aerosol container, so as to prevent discharge of any of the aerosol product during installation of said actuator assembly on the aerosol container and thereafter allowing product dispensing.

2. An actuator assembly according to claim 1, wherein said base is provided with a bearing surface and said actuator is provided with a mating bearing surface which facilitate axially sliding of said actuator along said longitudinal axis of said though bore.

3. An actuator assembly according to claim 1, wherein said base is provided with an outwardly facing annular recess which engages with an inwardly facing surface of a mounting cup, attached to the aerosol container, to attach said actuator assembly to the aerosol container.

4. An actuator assembly according to claim 3, wherein said base includes a collar located remote from said annular recess, and said collar includes a collar opening which is aligned with said discharge outlet to facilitate dispensing of the aerosol product.

5. An actuator assembly according to claim 4, wherein said cooperating members which permanently align said actuator relative to said base comprise a guide member supported by said base and a mating guide slot supported by said actuator and said guide member and said guide slot cooperate with one another to maintain said discharge outlet substantially aligned with said collar opening during dispensing of the aerosol product.

6. An actuator assembly according to claim 1, wherein said base includes an inner wall and an outer wall which define a cavity therebetween and the outer wall has an inwardly facing annular member which engages with one of a mounting cup and a rim of the aerosol container.

7. An actuator assembly according to claim 1, wherein said cooperating members which permanently retain said actuator within said through bore comprise a pair of stop members a pair of stop members located at opposed ends of said through bore which cooperate with one another to permanently retain said actuator within said through bore.

8. An actuator assembly according to claim 7, wherein said actuator is provided with a shoulder and said shoulder is in an abutting engagement with one of said pair of stop members;

and at least one frangible member interconnects said actuator with said base to maintain said shoulder and said stop member in abutting engagement.

9. An actuator assembly according to claim 7, wherein both of said bearing surfaces are cylindrical surfaces.

10. An aerosol container according to claim 1, wherein said base includes a shoulder to prevent over-insertion of said base into said mounting cup during installation of said actuator assembly.

11. An actuator assembly according to claim 1, wherein said product inlet communicates with a central bore provided within said actuator and a shoulder is formed within said central bore for abutting against a top surface of the stem and facilitate depression of the stem during actuation of the actuator.

12. An actuator assembly according to claim 11, wherein said central bore communicates with said discharge outlet via a radial bore.

13. An actuator assembly according to claim 12, wherein said actuator is provided with a finger recess for accommodating a finger of a user to facilitate depression of said actuator.

14. An actuator assembly according to claim 1, wherein a overcap is secured to said base to prevent inadvertent depression of said actuator.

15. An actuator assembly according to claim 14, wherein said overcap has a first mating member and said base member has a second mating member for releasably retaining said overcap engaged with said base.

16. An actuator assembly according to claim 15, wherein said first mating member is an inwardly facing annular rib provided on said overcap and said second mating member is an outwardly facing annular groove provided in said base.

17. An actuator assembly according to claim 1, wherein said cooperating members which permanently retain said actuator within said through bore comprise a pair of stop members located at opposed ends of said through bore, and said cooperating members which permanently align said actuator relative to said base comprise a guide member supported by said base and a mating guide slot supported by said actuator.

18. An actuator assembly for an aerosol container containing a stem for controlling dispensing of an aerosol product, said actuator assembly comprising:

a base defining a longitudinal axis and having a though bore extending therethrough, and an attachment mechanism for attaching said base to an aerosol container containing an aerosol product; and an actuator being at least partially supported within said though bore, and said actuator having a product inlet and a discharge outlet, communicating with one another, for dispensing the aerosol product;

wherein opposed ends of said through bore are provided with a pair of stop members which permanently retain said actuator within said through bore, said base and said actuator are provided with mating surfaces which facilitate axially sliding of said actuator along said longitudinal axis of said though bore, and said actuator is slidable along said longitudinal axis of said though bore a sufficient distance such that said inlet of said actuator insufficiently engages with a stem of the aerosol container, upon completion of installation of said actuator assembly on the aerosol container, so as to prevent discharge of any of the aerosol product during installation of said actuator assembly on the aerosol container.

19. An actuator assembly in combination with an aerosol container;

said aerosol container comprising a substantially closed container being opened at one end thereof, a mounting cup closing the open end of said aerosol container and supporting a valve, a valve stem extending through said mounting cup and having an opposed end thereof communicating with an interior of said aerosol container, via a passageway, for dispensing of an aerosol product from said aerosol container to the exterior environment via said valve stem;

said actuator assembly comprising:

a base defining a longitudinal axis and having a though bore extending therethrough, and an attachment mechanism for attaching said base to said aerosol container containing an aerosol product; and an actuator being at least partially supported within said though bore, and said actuator having a product inlet and a discharge outlet, communicating with one another, for dispensing the aerosol product;

wherein said through bore and said actuator are provided with cooperating members which permanently retain said actuator within said through bore and permanently align said actuator relative to said base to prevent rotation of said actuator relative to said base about said longitudinal axis, while said cooperating members allow said actuator to slide along said longitudinal axis of said though bore a sufficient distance such that said inlet of said actuator insufficiently engages with said stem of the aerosol container, upon completion of the installation of said actuator assembly on said aerosol container, so as to prevent discharge of any of the aerosol product during installation of said actuator assembly on the aerosol container and thereafter allowing product dispensing.

20. A method of installing an actuator assembly on an aerosol container without discharging any aerosol product during installation, said method comprising the steps of:

providing an aerosol container comprising a substantially closed container being opened at one end thereof, closing the open end of the aerosol container with a mounting cup, and extending a valve stem, of a valve, through the mounting cup, with the valve communicating with an interior of the aerosol container, via a passageway, for dispensing of an aerosol product from the aerosol container to the exterior environment via the valve stem;

forming a though bore within a base, and the though bore defining a longitudinal axis;

providing a mechanism for attaching said base to the aerosol container containing the aerosol product;

at least partially supporting an actuator within said though bore, and said actuator having a product inlet and a discharge outlet, communicating with one another, for dispensing the aerosol product;

providing said through bore and said actuator with cooperating members which permanently retain said actuator within said through bore and permanently align said actuator relative to said base to prevent rotation of said actuator relative to said base about said longitudinal axis, while said cooperating members allowing said actuator to slide along said longitudinal axis of said though bore a sufficient distance such that said inlet of said actuator insufficiently engages with the stem of the aerosol container, upon completion of the installation of said actuator assembly on the aerosol container, so as to prevent discharge of any of the aerosol product during installation of said actuator assembly on the aerosol container and thereafter allowing product dispensing.

* * * * *